US006878326B2

(12) United States Patent
Cho et al.

(10) Patent No.: US 6,878,326 B2
(45) Date of Patent: Apr. 12, 2005

(54) PROCESS FOR PREPARING INDUSTRIAL POLYESTER MULTIFILAMENT YARN

(75) Inventors: Eun-lai Cho, Seoul (KR); Song-joo Choi, Ulsan (KR); Jong Lee, Seoul (KR)

(73) Assignee: HYOSUNG Corporation, Seoul (KR)

( * ) Notice: Subject to any disclaimer, the term of this patent is extended or adjusted under 35 U.S.C. 154(b) by 36 days.

(21) Appl. No.: 10/032,558

(22) Filed: Jan. 2, 2002

(65) Prior Publication Data

US 2003/0099830 A1 May 29, 2003

(30) Foreign Application Priority Data

Oct. 31, 2001 (KR) ..... 2001-67459

(51) Int. Cl.[7] ..... D01D 5/12

(52) U.S. Cl. ..... 264/210.7; 264/210.1; 264/210.8

(58) Field of Search ..... 264/210.1, 210.7, 264/210.8

(56) References Cited

U.S. PATENT DOCUMENTS

| | | | | | |
|---|---|---|---|---|---|
| 4,349,501 | A | | 9/1982 | Hamlyn | |
| 4,851,172 | A | | 7/1989 | Rowan et al. | |
| 5,049,339 | A | * | 9/1991 | Hrivnak et al. | 264/210.8 |
| 5,102,603 | A | * | 4/1992 | Oblath et al. | 264/210.8 |
| 5,137,670 | A | * | 8/1992 | Murase et al. | 264/130 |
| 5,525,424 | A | * | 6/1996 | Anderson et al. | 428/395 |
| 5,562,988 | A | * | 10/1996 | Anderson et al. | 428/395 |
| 5,630,976 | A | * | 5/1997 | Nelson et al. | 264/210.8 |
| 6,403,006 | B1 | * | 6/2002 | Nelson et al. | 264/210.8 |
| 6,511,624 | B1 | | 1/2003 | Cho et al. | |
| 2003/0049445 | A1 | * | 3/2003 | Nelson et al. | 428/373 |
| 2003/0099830 | A1 | * | 5/2003 | Cho et al. | 428/375 |
| 2003/0207111 | A1 | * | 11/2003 | Nelson et al. | 428/395 |

FOREIGN PATENT DOCUMENTS

| | | |
|---|---|---|
| JP | 5-32491 | 5/1993 |
| JP | 7-70819 | 3/1995 |

OTHER PUBLICATIONS

English Language Abstract of JP 5–32491.
English Language Abstract of JP 7–70819.

* cited by examiner

*Primary Examiner*—Rena Dye
*Assistant Examiner*—J. Gray
(74) *Attorney, Agent, or Firm*—Greenblum & Bernstein, P.L.C.

(57) ABSTRACT

Process for preparing an industrial polyester multifilament yarn with high modulus and low shrinkage, in which polyethylene terephthalate polyester is wound at 2000 m/min or more to produce undrawn yarns with an intrinsic viscosity of 0.88 or higher and a density of 1.338 to 1.365 g/cm$^3$, an oiling agent is provided to undrawn yarns, the resulting undrawn yarns are wound, drawn through three stages, heat set, relaxed, and wound again. The polyethylene terephthalate polyester yarn is produced by drawing undrawn yarns at a glass transition temperature (Tg, about 80° C.) or lower through three stages under conditions that a draw ratio of the 1st stage is greater than a draw ratio of the 2nd stage or a draw ratio of the 3rd stage and the draw ratio of the 3rd stage is greater than the draw ratio of the 2nd stage. Also, the industrial polyester yarn with high modulus and low shrinkage has an elongation 1% or more higher, and terminal modulus 10 g/d or more lower than conventional polyester high modulus low shrinkage yarns, if tenacities are identical. Treated cords formed from the polyester yarns with high modulus and low shrinkage have an excellent dimensional stability and tenacity, and so are useful as tire cords.

2 Claims, 1 Drawing Sheet

PROCESS FOR PREPARING INDUSTRIAL POLYESTER MULTIFILAMENT YARN

BACKGROUND OF THE INVENTION

1. Field of the Invention

The present invention relates, in general, to a process for preparing an industrial polyester multifilament yarn, and in particular, to a process for preparing an industrial polyester multifilament yarn with high modulus and low shrinkage useful as fiber reinforcements of tires. A treated cord produced from the polyester multifilament yarn has an excellent dimensional stability, i.e. high modulus and low shrinkage, and a high tenacity.

2. Description of the Prior Art

Fundamentally applied for the preparation of industrial high modulus/low shrinkage polyester multifilament yarns at high spinning speeds, a multi-stage spin draw process is generally conducted above the glass transition temperature (about 80° C.) and preferably at 110° C. or higher.

According to Japanese Patent Publication No. Hei. 5-32491 by Isoo Saito et al., a drawing temperature is 120° C., and U.S. Pat. No. 4,349,501 by Maxwell C. Hamlyn et al. and U.S. Pat. No. 4,851,172 by Hugh H. Rowan et al. disclose a draw point localizing method with the use of steam at 300° C. or higher.

Furthermore, Japanese Patent Laid-Open Publication No. Hei. 7-70819 by Masayasu Nagao et al. discloses a multi-phase drawing method, in which undrawn yarns with an intrinsic viscosity of 0.85 or more and a density of 1.365 g/cm$^3$ or more are produced by winding yarns at 2500 to 6000 m/min, then undrawn yarns are drawn through multiple stages at 100° C. or lower. However, an object of this invention is to provide a polyester yarn with high modulus and low shrinkage, in which the modulus and the shrinkage of the polyester yarn are similar to those of rayon or vinylon, and so this invention cannot be applied to tire cords requiring high strength.

Particularly, undrawn yarns with a density of above 1.365 g/cm$^3$ have such a high orientation and crystallinity that undrawn yarns can hardly be mechanically drawn, therefore, high strength yarns of above 7.2 g/d required to manufacture tire cords are very difficult to produce.

And Japanese Patent Laid-Open Publication No. Hei. 7-70819, undrawn yarns are drawn at 100° C. or lower through multiple-stages after passing a pre-draw stage.

SUMMARY OF THE INVENTION

Therefore, it is an object of the present invention to provide a process for preparing an industrial polyester multifilament yarn with high strength, high modulus, and low shrinkage by use of highly oriented undrawn yarns.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
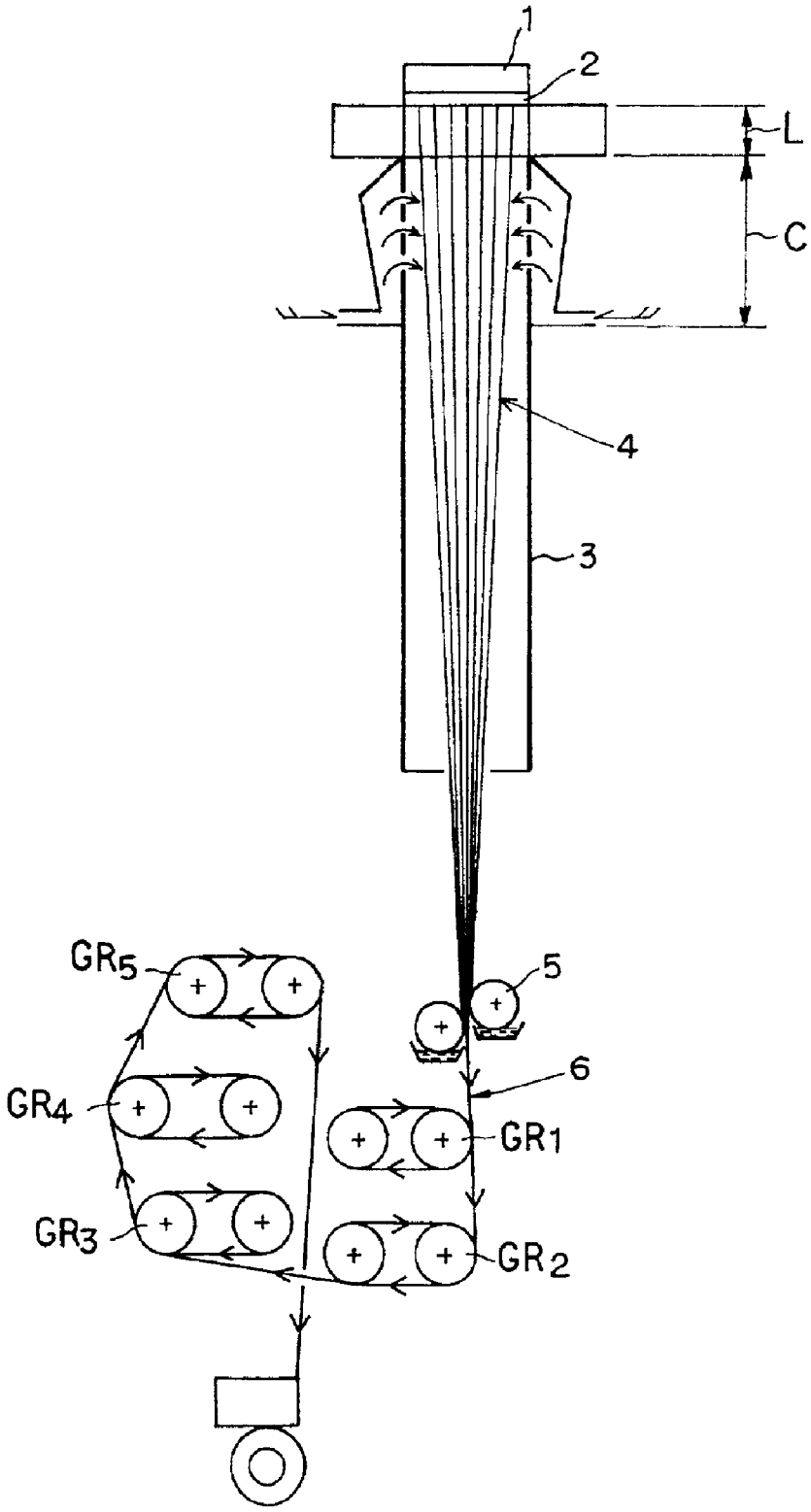
FIG. 1 schematically illustrates a process for preparing an industrial polyester multifilament yarn according to the present invention.

The present invention is different from Japanese Patent Laid-Open Publication No.; Hei 5-32491 by Isoo Saito et al., or a conventional hot drawing method (including draw point localizing with the use of heated steam etc), and Japanese Patent Laid-Open Publication No. Hei 7-70819 by Masayasu Nagao et al. disclosing a process for preparing a polyester yarn with high modulus and low shrinkage of levels similar to those of rayon or vinylon, in that a density of undrawn yarns is controlled within a range of 1.338 to 1.365 g/cm$^3$ by controlling a spinning speed and spinning conditions, and high strength yarns of 7.2 g/d or more can be produced by cold-drawing the undrawn yarns at a glass transition temperature (about 80° C.) or lower through three phases.

The present inventors have conducted extensive studies into a method for increasing an elongation in order to prepare the polyester multifilament yarn with high strength, high modulus, and low shrinkage by use of highly oriented undrawn yarns, resulting in the finding that when the polyester yarn is drawn at the glass transition temperature ($T_g$, about 80° C.) or lower, an oriented crystallization rapidly generated during drawing is suppressed, thereby the elongation is increased in comparison with a conventional hot drawing method in which the polyester yarn is finally drawn above the glass transition temperature ($T_g$, about 80° C.).

The present invention provides a process for preparing an industrial polyester multifilament yarn with high modulus and low shrinkage, in which undrawn yarns with a density of 1.338 to 1.365 g/cm$^3$ are drawn through three stages at the glass transition temperature (about 80° C.) or lower without a pre-draw step, heat-set, relaxed, and wound. The resulting drawn yarns can be usefully applied to tire cord yarns requiring a terminal modulus of 35 g/d or less and a high strength of 7.2 g/d or more.

According to the present invention, a process for preparing an industrial polyester multifilament yarn comprises-the steps of:

A) melt-extruding a polyester polymer having ethylene terephthalate repeating units of 95 mol % or more and passing the extruded yarn through a delay quenching zone with a length of L (with or without heating) and then a quenching zone C in an upper side of a spin tube 3 to solidify the yarn to have an intrinsic viscosity of 0.88 or more;

B) oiling and taking up the undrawn yarn at an appropriate speed with the density of 1.338 to 1.365 g/cm$^3$ and C) drawing the yarns at a glass transition temperature (about 80° C.) or lower in three stages with the proviso that the draw ratio is greater in the 1$^{st}$ stage than in the 2$^{nd}$ stage or the 3$^{rd}$ stage and greater in the 3$^{rd}$ stage than in the 2$^{nd}$ stage, heat-setting the drawn yarns at 200 to 250° C., relaxing heat-set yarns by 1 to 4%, and winding the resulting yarns.

In other words, the present invention is characterized in that highly oriented polyethylene terephthalate undrawn yarns are low temperature drawn at the glass transition temperature (about 80° C.) or lower through three phases without a pre-draw step, in which undrawn yarns are drawn by 1 to 10% before a main drawing stage so as for filaments to be uniformly drawn.

When the intrinsic viscosity of undrawn yarns is less than 0.88, a strength retention of a treated cord to a strength of a yarn is lowered, and when the density of undrawn yarns is less than 1.338 g/cm$^3$, high modulus and low shrinkage required from tire cord yarns cannot be obtained. On the other hand, when the density is more than 1.365 g/cm$^3$, drawing is very difficult to accomplish because undrawn yarns are highly oriented and somewhat crystallized, and so high strength yarn of 7.2 g/d or more is very hard to produce.

When highly oriented undrawn yarns are drawn, a crystallization owing to a drawing temperature and an orientation is more likely in comparison with low oriented undrawn yarns.

Therefore, when highly oriented undrawn yarns are drawn, a draw ratio of $1^{st}$ stage should be increased as much as possible in order to suppress crystallization and increase total draw ratio.

If the draw ratio of the $2^{nd}$ stage is high, it is disadvantageous to draw yarns in the $3^{rd}$ drawing stage because the crystallinity of the yarn is increased after a $2^{nd}$ drawing stage.

According to the invention, therefore, the drawing stage is carried out under conditions that the draw ratio of the $2^{nd}$ stage is lowered and the draw ratio of the $3^{rd}$ stage is increased, thereby the drawing is advantageously accomplished.

According to the present invention, the resulting drawn yarns can be converted to treated cords according to the traditional method.

For example, cord yarns are produced by plying and cabling drawn yarns of two strands of 1500 deniers in 390 twist/m (based on a conventional polyester treated cord). Then, the cord yarns are heat set with a stretch of 2.0 to 6.0% at 235 to 245° C. for 1.5 to 2.5 min to produce treated cords. The resulting treated cords (produced by plying and cabling drawn yarns of two strands of 1500 deniers in 390 tpm) have $E_{2.25}$+FS of 6.0 to 8.0% and a tenacity of 6.5 to 7.2 g/d.

As described above, the treated cords produced from polyester multifilament yarns with high modulus and low shrinkage of the present invention have excellent dimensional stability and tenacity, thereby being usefully applied to reinforcements of rubber products such as tires and industrial belts, or other industrial applications.

EXAMPLE AND COMPARATIVE EXAMPLE

A better understanding of the present invention may be obtained in light of the following examples which are set forth to illustrate, but are not to be construed to limit the present invention.

Physical properties of multifilament yarns and treated cords according to examples and comparative examples of the present invention are estimated as follows:

(1) Intrinsic Viscosity (I.V.)

0.1 g of a sample was dissolved at 90 ° C. for 90 min in an agent containing phenol and 1,1,2,3-tetrachloroethane at a weight ratio of 6:4, such that a concentration of the resulting mixture was 0.4 g/100 ml, and then the resulting mixture was charged into an Ubbelohde viscometer and maintained in a thermostat at 30° C. for 10 min. After that, drops per second of the resulting solution and a solvent, respectively, were measured with the use of the viscometer and an aspirator. Next, R.V. and I.V. were calculated by the following equations 1 and 2, respectively.

$$R.V.=\text{drops per second of a sample/drops per second of a solvent} \quad \text{Equation 1}$$

$$I.V.=\tfrac{1}{4}\times\{(R.V.-1)/C\}+\tfrac{3}{4}\times(\ln R.V./C) \quad \text{Equation 2}$$

wherein, C is a concentration of a sample in a solution (g/100 ml)

(2) Strength and Elongation

A sample 250 mm long was measured for strength and elongation under a standard state (20° C., relative humidity of 65%) according to ASTM D 885 with the use of Instron 5565 (Instron, USA) at a tension speed of 300 mm/min and at 80 turns/m.

(3) Terminal Modulus

In a curve drawn from the strength and elongation data measured in (2), a terminal modulus was calculated by substituting into the following equation a value subtracting 2.4% from a maximum strain at breaking strength, indicating a maximum strength at break:

$$\text{Terminal Modulus } (g/d)=\text{increase of tenacity to a maximum strength at break}/2.4\times100 \quad \text{Equation 3}$$

(4) Density and Crystallinity

A density was measured with the use of a xylene/carbon tetrachloride density column at 23° C. The density column had a density range of 1.34 to 1.41 g/cm$^3$, and was produced according to ASTM D 1505.

$$\text{Crystallinity } (\%)=\rho c/\rho\times(\rho-\rho a)/(\rho c-\rho a) \quad \text{Equation 4}$$

wherein, ρ is a density of a sample (g/cm$^3$), ρc and ρa are densities of a crystal portion (1.455 g/cm$^3$) and an amorphous portion (1.335 g/cm$^3$), respectively.

(5) Birefringence

A birefringence was measured by a polarized microscope with a Berek compensator, by the following procedure:

A polarizer and an analyzer were positioned at right angles to each other (orthogonal polarization);

A compensator was inserted into the polarized microscope in such a way that the compensator met the analyzer at an angle of 45° (an angle of 45° to the N-S direction of a microscope).

A sample was put on a stage at a diagonal position ($n_y$-direction: the polarizer met the sample at an angle of 45°)—a black compensation band was observed at this position.

A scale was read at a position, at which a center of the sample was darkest while a micrometer screw of the compensator revolved to the right.

The scale was read again at the position, at which the center of the sample was darkest while the micrometer screw of the compensator revolved to the left.

A difference between the above two scales was divided by 2 to produce a slope angle, and a retardation (v, nm) was obtained from the slope angle with reference to a reference table supplied by the manufacturer.

$$i=(a-b)/2$$

wherein, i slope angle once>90°: a once<90°: b

The compensator and the analyzer were removed, and then a thickness (d, nm) of the sample was measured with the use of an eyefilar micrometer.

A birefringence (Δn) of the sample was calculated by substituting the retardation and the thickness values into the following equation $$\Delta n=\gamma/d$$

(6) Shrinkage

A sample was left at a temperature of 20° C. and a relative humidity of 65% under a standard state for 24 hours or more, and then a length ($L_o$) of the sample was measured, which had a weight corresponding to 0.1 g/d. After that, the sample was treated under a tensionless state at 150° C. for 30 min with the use of a dry oven, followed by being left for 4 hours or more after the sample was removed from the dry oven. The length (L) of the resulting sample was measured, which had the weight corresponding to 0.1 g/d, then the shrinkage was calculated by equation 5, below.

$$\Delta S\%=(L_o-L)/L_o\times100 \quad \text{Equation 5}$$

(7) Middle Elongation

With the use of the strength and elongation S-S curve, the elongation of a grey yarn was measured at a load of 4.5 g/d and the elongation of a treated cord was measured at a load of 2.25 g/d.

(8) Dimensional Stability

A dimensional stability of the treated cord, which is physical property related with a side wall indentation (SWI) and a handling of tires, was defined as a modulus in a given shrinkage. $E_{2.25}$(elongation at 2.25 g/d)+FS (free shrinkage) is useful as an index of the dimensional stability of treated cords produced through different heat treatment processes. The lower $E_{2.25}$+FS is, the better the dimensional stability is.

Example 1

Solid phase polymerized polyethylene terephthalate chips with an intrinsic viscosity of 1.07 and a moisture regain of 20 ppm were prepared in a presence of a polymerization catalyst, i.e. antimony compound, which was present in an amount of 220 ppm as antimony metal in the polymer. Chips thus prepared were melt-spun at 850 g/min and 298° C. with the use of an extruder so that the monofilament fineness of the final drawn yarn was 4 deniers.

Then, spun yarns 4 in a spin tube 3 were passed through a non-heating zone L with a length of 150 mm directly below the nozzle and a quenching zone C with a length of 530 mm, in which air of 20° C. circulates at a rate of 0.5 m/sec, to be solidified.

Thereafter, solidified spun yarns were oiled with aqueous spin finishes containing undiluted chemical of 15%, wound at 2300 m/min to produce undrawn yarns 6, drawn through three stages, heat set at 240° C., and relaxed by 2.0%, and finally wound to produce final drawn yarns (grey yarns) of 1500 deniers/384 filaments.

Cord yarns were produced by plying and cabling the resulting drawn yarns of two strands in 390 twists/m. The cord yarns were dipped into a RFL liquid two times, and heat set with a stretch of 2.0 to 6.0% at 235 to 245° C. for 1.5 to 2.5 min to produce a treated cord.

Physical properties of undrawn yarns, drawn yarns, and treated cords were evaluated, and the results are described in Tables 1, 2, and 3.

TABLE 1

| | I.V. of chips | [1]Beam Temp. (° C.) | I.V. of undrawn yarn | [2]Finess (denier) | [3]Leng (mm) | [4]Quench. [5]D (mm) | [4]Quench. [6]L (mm) | [4]Quench. [7]Vel (m/s) | [8]Speed (m/min) | Undrawn yarn [9]Biref | Undrawn yarn [10]Den (g/cm$^3$) | Undrawn yarn [11]Cryst (%) |
|---|---|---|---|---|---|---|---|---|---|---|---|---|
| Ex. 1 | 1.07 | 298 | 0.95 | 4 | 150 | 270 | 530 | 0.5 | 2300 | 0.035 | 1.340 | 4.5 |

[1]Temperature of spinning beam
[2]Monofilament fineness
[3]Length of hot zone
[4]Quenching zone
[5]Inner diameter
[6]Length
[7]Air velocity
[8]Spinning speed
[9]Birefringence
[10]Density
[11]Crystallinity

TABLE 2

| | Drawing conditions | | | | | | | | | |
|---|---|---|---|---|---|---|---|---|---|---|
| | [1]GR2/GR1 | [2]GR3/GR2 | [3]GR4/GR3 | [4]GR5/GR4 | [5]Total draw ratio | GR1 Temp (° C.) | GR2 Temp (° C.) | GR3 Temp (° C.) | GR4 Temp (° C.) | GR5 Temp (° C.) |
| Ex. 1 | 1.50 | 1.15 | 1.30 | 0.98 | 2.24 | 60 | 60 | 75 | 230 | 130 |

[1]GR2/GR1 (draw ratio of 1st stage)
[2]GR3/GR2 (draw ratio of 2nd stage)
[3]GR4/GR3 (draw ratio of 3rd stage)
[4]GR5/GR4 (relaxing ratio)
[5]Total draw ratio (GR4/GR1 speed ratio)*
GR: godet roller

TABLE 3

| | Drawn yarn | | | | | | | Dipped cord | | | |
|---|---|---|---|---|---|---|---|---|---|---|---|
| | I.V. | [1]Ten. (g/d) | [2]Mid. Elng. (%) | [3]Elon. (%) | [4]Shrk. (%) | [5]Modul. (g/d) | O.P.U. (%) | [1]Ten. (g/d) | [2]Mid. Elng. (%) | [4]Shrk. (%) | E + FS (%) |
| Ex. 1 | 0.935 | 8.0 | 6.4 | 14.7 | 6.0 | 18.0 | 0.7 | 6.8 | 4.5 | 2.9 | 7.4 |

[1]Tenacity
[2]Middle elongation
[3]Elongation
[4]Shrinkage
[5]Terminal modulus

Examples 2 to 4 and Comparative Examples 1 to 11

The procedure of example 1 was repeated except that undrawn yarns were prepared under conditions of Table 4 and drawn under conditions of Table 5.

Cord yarns were produced by plying and cabling the resulting drawn yarns of two strands in 390 twists/m. The cord yarns were dipped into a RFL liquid two times, and heat set with a stretch of 2.0 to 6.0% at 235 to 245° C. for 1.5 to 2.5 min to produce a treated cord. Physical properties of the treated cord were evaluated, and the results are described in Table 6.

TABLE 4

| | | Undrawn yarn | | |
|---|---|---|---|---|
| | Spinning speed (m/min) | Birefringence | Density (g/cm$^3$) | Crystallinity (%) |
| Co. Ex. 1 to 5 | 2300 | 0.035 | 1.340 | 4.5 |
| Co. Ex. 6 to 7 and Ex. 2 | 2700 | 0.070 | 1.348 | 9.0 |
| Co. Ex. 8 to 9 and Ex. 3 | 3000 | 0.090 | 1.360 | 17.9 |
| Co. Ex. 10 | 3300 | 0.011 | 1.372 | 29.2 |
| Co. Ex. 11 | 2000 | 0.025 | 1.337 | 1.8 |

TABLE 5

| | Drawing conditions | | | | | | | | | | |
|---|---|---|---|---|---|---|---|---|---|---|---|
| | [1]GR2/GR1 | [2]CR3/CR2 | [3]GR4/GR3 | [4]GR5/GR4 | [5]Total draw ratio | GR1 Temp (° C.) | GR2 Temp (° C.) | GR3 Temp (° C.) | GR4 Temp (° C.) | GR5 Temp (° C.) | Note |
| C. E. 1 | 1.04 | 1.6 | 1.3 | 0.98 | 2.16 | 60 | 110 | 120 | 230 | 130 | X |
| C. E. 2 | 1.04 | 1.6 | 1.3 | 0.98 | 2.16 | 60 | 90 | 100 | 230 | 130 | X |
| C. E. 3 | 1.5 | 1.3 | 1.1 | 0.98 | 2.16 | 60 | 90 | 100 | 230 | 130 | X |
| C. E. 4 | 1.5 | 1.15 | 1.3 | 0.98 | 2.24 | 60 | 110 | 120 | 230 | 130 | XX |
| C. E. 5 | 1.5 | 1.3 | 1.15 | 0.98 | 2.24 | 60 | 60 | 75 | 230 | 130 | X |
| Ex. 2 | 1.4 | 1.1 | 1.27 | 0.98 | 1.96 | 60 | 60 | 75 | 230 | 130 | ○ |
| C. E. 6 | 1.04 | 1.5 | 1.2 | 0.98 | 1.87 | 60 | 110 | 120 | 230 | 130 | X |
| C. E. 7 | 1.4 | 1.27 | 1.1 | 0.98 | 1.96 | 60 | 60 | 75 | 230 | 130 | XX |
| Ex. 3 | 1.4 | 1.1 | 1.2 | 0.98 | 1.85 | 60 | 60 | 75 | 230 | 130 | ○ |
| C. E. 8 | 1.04 | 1.4 | 1.2 | 0.98 | 1.75 | 60 | 110 | 120 | 230 | 130 | X |
| C. E. 9 | 1.4 | 1.2 | 1.1 | 0.98 | 1.85 | 60 | 60 | 75 | 230 | 130 | X |
| C. E. 10 | 1.3 | 1.1 | 1.2 | 0.98 | 1.72 | 60 | 60 | 75 | 230 | 130 | X |
| C. E. 11 | 1.6 | 1.1 | 1.4 | 0.98 | 2.69 | 60 | 60 | 75 | 230 | 130 | X |

[1]GR2/GR1 (draw ratio of 1$^{st}$ stage)
[2]GR3/GR2 (draw ratio of 2$^{nd}$ stage)
[3]GR4/GR3 (draw ratio of 3$^{rd}$ stage)
[4]GR5/GR4 (relaxing ratio)
[5]Total draw ratio (GR4/GR1 speed ratio)
*Note
○: good in appearance,
X: bad in appearance,
XX: very bad in appearance Total draw ratio of examples was determined as 95% of the draw ratio obtained in the yarn wound for 5 min. In comparative examples, total draw ratio was determined as highest draw ratio based on total draw ratio of examples.

TABLE 6

| | Drawn yarn | | | | | | | Dipped cord | | | |
|---|---|---|---|---|---|---|---|---|---|---|---|
| | I.V. | [1]Ten. (g/d) | [2]Mid. Elng. (%) | [3]Elon. (%) | [4]Shrk. (%) | [5]Modul. (g/d) | O.P.U. (%) | [1]Ten. (g/d) | [2]Mid. Elng. (%) | [4]Shrk. (%) | E + FS (%) |
| C. E. 1 | 0.93 | 7.5 | 6.2 | 13.0 | 5.8 | 55 | 0.7 | 6.6 | 4.5 | 3.0 | 7.5 |
| C. E. 2 | 0.93 | 7.5 | 6.5 | 13.5 | 6.4 | 40 | 0.7 | 6.5 | 4.5 | 3.0 | 7.5 |
| C. E. 3 | 0.93 | 7.5 | 6.4 | 13.0 | 6.2 | 40 | 0.7 | 6.6 | 4.5 | 3.0 | 7.5 |
| C. E. 4 | 0.93 | 7.8 | 5.5 | 12.5 | 6.2 | 65 | 0.7 | | | | |
| C. E. 5 | 0.93 | 7.5 | 6.4 | 14.0 | 6.4 | 40 | 0.7 | 6.6 | 4.5 | 3.0 | 7.5 |
| Ex. 2 | 0.93 | 7.4 | 5.5 | 14.5 | 5.5 | 27 | 0.7 | 6.7 | 4.0 | 2.5 | 6.5 |
| C. E. 6 | 0.93 | 7.1 | 5.5 | 13.0 | 5.0 | 60 | 0.7 | 6.3 | 4.0 | 2.5 | 6.5 |
| C. E. 7 | 0.93 | 7.1 | 5.5 | 13.0 | 5.5 | 45 | 0.7 | 6.3 | 4.0 | 2.5 | 6.5 |
| Ex. 3 | 0.93 | 7.3 | 5.5 | 14.5 | 5.0 | 25 | 0.7 | 6.5 | 4.0 | 2.2 | 6.2 |
| C. E. 8 | 0.93 | 7.0 | 5.5 | 13.0 | 4.5 | 65 | 0.7 | 6.2 | 4.0 | 2.3 | 6.3 |
| C. E. 9 | 0.93 | 7.0 | 5.5 | 13.3 | 5.0 | 40 | 0.5 | 6.2 | 4.0 | 2.2 | 6.2 |
| C. E. 10 | 0.93 | 6.8 | 5.5 | 14.0 | 4.5 | 40 | 0.5 | 6.2 | 4.0 | 2.2 | 6.2 |
| C. E. 11 | 0.93 | 8.2 | 6.0 | 11.5 | 8.5 | 60 | 0.7 | 6.6 | 4.5 | 4.5 | 9.0 |

[1]Tenacity
[2]Middle elongation
[3]Elongation
[4]Shrinkage
[5]Terminal modulus

As described above, the present invention provides a process for preparing an industrial high strength polyester multifilament yarn with a high modulus and a low shrinkage at the glass transition temperature (about 80° C.) or lower, with high elongation efficiency. The industrial polyester multifilament yarn of the present invention has a tenacity of 7.2 g/d or more and a terminal modulus of 35 g/d or less.

When the polyester high modulus low shrinkage yarn of the present invention is compared to the polyester high modulus low shrinkage yarn according to a conventional direct spinning hot spin draw process, if each tenacity is identical, the polyester yarn of the present invention has an elongation 1% or more higher and a terminal modulus 10 g/d or more lower than conventional polyester yarn. Therefore, the present invention has advantages in that a strength availability is greatly improved during the drawing and post process, and so an elongation also is improved, thereby a fatigue resistance of treated cords is increased.

The present invention has been described in an illustrative manner, and it is to be understood that the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described.

The present disclosure relates to subject matter contained in priority Korean Patent Application No. 2001-67459, filed on Oct. 31, 2001, the contents of which are herein expressly incorporated by reference in its entirety.

What is claimed is:

1. A process for preparing an industrial polyester multifilament yarn, comprising:

A) melt-extruding a polyester polymer having ethylene terephthalate units of 90 mol % or more forming an extruded yarn and passing the extruded yarn through a delay quenching zone and then a quenching zone to solidify the extruded yarn as an undrawn yarn having an intrinsic viscosity of 0.88 or more;

B) oiling and taking up the undrawn yarn at a speed to provide an undrawn yarn having a density of 1.338 to 1.365 g/cm$^3$; and C) drawing the undrawn yarn at the glass transition temperature or lower in three stages with the proviso that the draw ratio is greater in the 1$^{st}$ stage than in the 2$^{nd}$ stage or the 3$^{rd}$ stage and greater in the 3$^{rd}$ stage than in the 2$^{nd}$ stage, heat-setting the drawn yarn, relaxing the heat-set yarn, and winding the resulting yarn, to obtain an industrial polyester multifilament yarn having a terminal modulus of 35 g/d or less and a tenacity of 7.2 g/d or more.

2. The process according to claim 1, wherein the undrawn yarn is drawn at a total draw ratio of 1.5 to 2.5.

* * * * *